US006879311B2

(12) United States Patent
Sono

(10) Patent No.: US 6,879,311 B2
(45) Date of Patent: Apr. 12, 2005

(54) APPARATUS AND METHOD OF CONTROLLING DRIVING VOLTAGE FOR IMAGE DISPLAY DEVICE

(75) Inventor: Koich Sono, Suwon-si (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 276 days.

(21) Appl. No.: 10/287,768

(22) Filed: Nov. 5, 2002

(65) Prior Publication Data

US 2003/0117361 A1 Jun. 26, 2003

(30) Foreign Application Priority Data

Dec. 15, 2001 (KR) ..... 2001-79714

(51) Int. Cl.[7] ..... G09G 3/36

(52) U.S. Cl. ..... 345/94; 345/87; 345/98; 353/20; 349/8

(58) Field of Search ..... 345/87, 94, 98–100; 353/20, 119, 122; 348/251; 349/8, 9, 58

(56) References Cited

U.S. PATENT DOCUMENTS 5,283,600 A * 2/1994 Imai ..... 353/34
6,266,102 B1 * 7/2001 Azuma et al. ..... 348/671
6,414,667 B1 * 7/2002 Bonnett et al. ..... 345/97
6,738,106 B1 * 5/2004 Tanahara et al. ..... 349/38

FOREIGN PATENT DOCUMENTS

JP 2000-289994 A 1/2000
KR 2001-0001597 U 1/2001

* cited by examiner

*Primary Examiner*—Bipin Shalwala
*Assistant Examiner*—Tom Sheng
(74) *Attorney, Agent, or Firm*—Sughrue Mion, PLLC

(57) ABSTRACT

Apparatus and method for controlling a driving voltage for an image display device, in which an optical sensor is installed between a liquid crystal display device and a screen or between the liquid crystal display device and a projection lens, and the driving voltage for the liquid crystal display device is feedback controlled using the output signal of the optical sensor in order to provide an optimal contrast. In this apparatus and method, the edge area of an image display device is subject to a minute change in the amplitude of a driving voltage, and the optical change is sensed and used to control the driving voltage of the image display device. Accordingly, regardless of property changes due to the temperature of an image display device and its peripheral devices, a picture can be displayed with an optimal contrast and blinking due to flickering can be minimized.

29 Claims, 8 Drawing Sheets

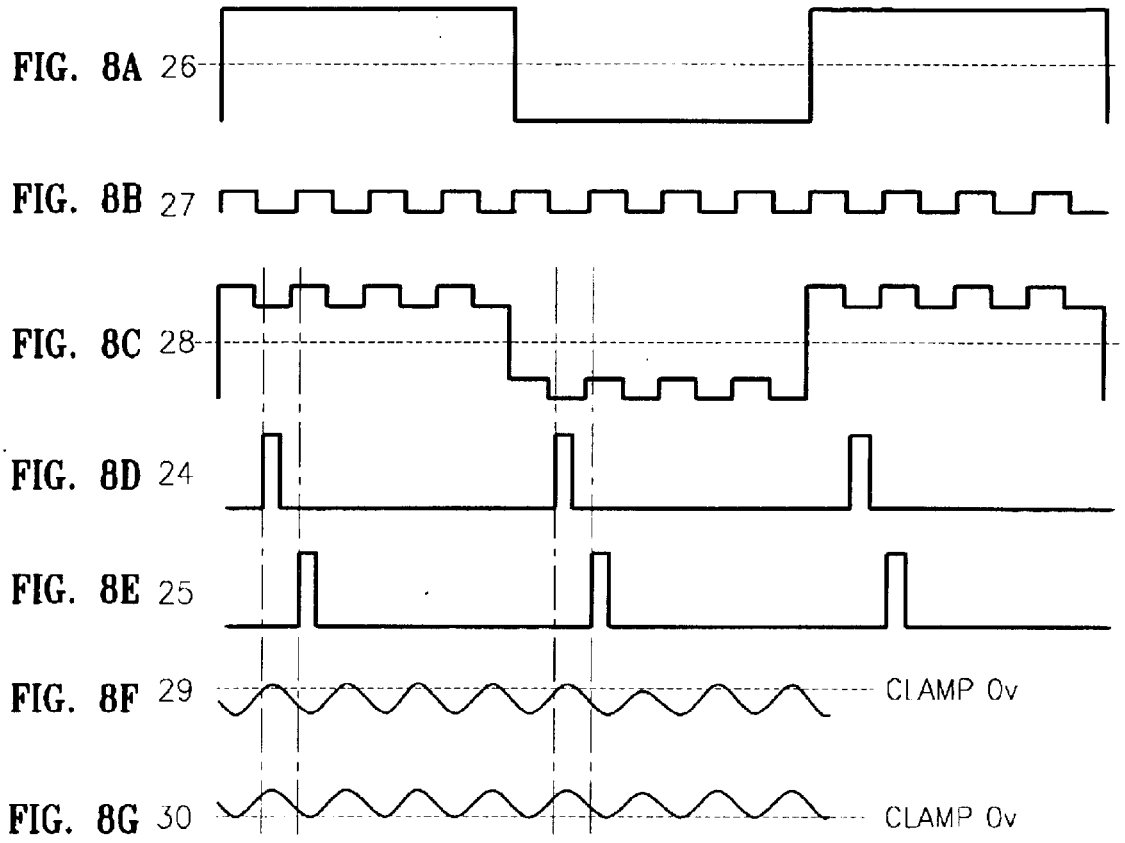
FIG. 9
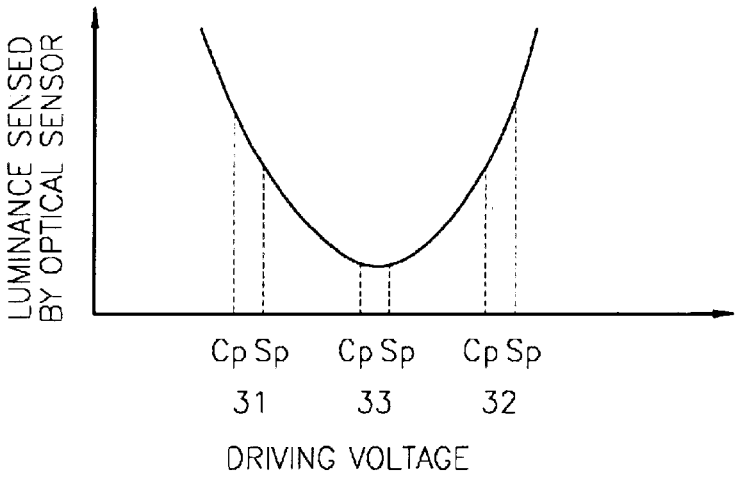

APPARATUS AND METHOD OF CONTROLLING DRIVING VOLTAGE FOR IMAGE DISPLAY DEVICE

BACKGROUND OF THE INVENTION

1. Field of the Invention

The present invention relates to an image display driving controlling apparatus and its method, and more particularly, to an apparatus and method for controlling a driving voltage for an image display device, in which an optical sensor is installed between the image display device and a screen, or between the image display device and a projection lens, and the driving voltage for the image display device is feedback controlled using the output signal of the optical sensor in order to provide an optimal contrast. The present application is based on Korean Patent Application No. 2001-79714, filed Dec. 15, 2001, the contents of which are incorporated herein by reference.

2. Description of the Related Art

As shown in FIG. 1, a conventional image display apparatus is composed of a reflex image display device 1, a polarization angle adjustor 2, a polarized beam splitter 3, a projection lens 4, a focusing lens 5, a light source lamp 6 and a pair of polarization plates 7.

In the conventional image display apparatus, light emitted from the light source lamp 6 passes through the focusing lens 5, is polarized in one direction by a polarization plate 7, and then is incident upon the polarized beam splitter 3. The polarized beam splitter 3 transmits a P wave out of the incident light and reflects an S wave to change the traveling direction of light by 90°.

The S wave reflected by the polarized beam splitter 3 is incident upon the image display device 1 via the polarization angle adjustor 2. In the image display device 1, image data as shown in FIG. 2(*a*) is written on its pixels. A voltage applied to pixels renders the pixels in an on or off state. Light re-reflected by the image display device 1 is projected onto a screen via the polarization angle adjustor 2, the polarized beam splitter 3, another polarization plate 7 and the projection lens 4 only when the re-reflected light is in an on state.

If the image display device 1 is formed of liquid crystal, when a voltage with a uniform polarity is continuously applied to liquid crystal, the image sticking defect that liquid crystal molecules are magnetized in one direction and consequently do not operate occurs. In order to prevent this, as shown in FIG. 2(*a*), there is a need to drive liquid crystal with alternating current (AC) by inverting image data at predetermined time intervals. However, if inverted images are displayed as they are, pictures whose white and black have been inverted appear on the screen. Accordingly, as shown in FIG. 2(*b*), the polarization angle adjustor 2 is inversion driven in synchronization with the image signal of FIG. 2(*a*). When the image signal has been inverted, it is re-inverted by the polarization angle adjustor 2 and output as non-inverted light.

If an analog liquid crystal display device is used for the image display device 1, an image signal as shown in FIG. 3(*a*) is applied to the pixels of the image display device 1. In this case, the analog liquid crystal display device 1 is driven with AC in order to prevent image sticking from occurring. Here, the liquid crystal display device is driven based on the voltages of opposing base electrodes installed in the liquid crystal display device, such that the polarization angle adjustor 2 is not required.

As described above, in the event that a digital image display device is used for the image display device 1, the driving voltage for the polarization angle adjustor 2 may change from the normal state of FIG. 2(*b*) to the state of FIG. 2(*c*) as the amplitude of the driving voltage is reduced due to a deterioration of component parts or a change in temperature. This causes a degradation in the contrast of an image. As shown in FIG. 2(*d*), when the positive voltage and negative voltage for AC driving are asymmetrical to each other with respect to the center voltage, the contrast is degraded, flickering (blinking) appears on the screen, the quality of an image is degraded, and unpleasant pictures are displayed.

Likewise, in the event that an analog image display device is used for the image display device 1, the driving voltage of an image signal changes from the normal voltage of FIG. 3(*a*) to the amplitude-reduced voltage of FIG. 3(*b*) or the driving voltage of FIG. 3(*c*) in which the center voltage deviates from the voltages of opposing base electrodes. In this case, the contrast of an image is degraded, and screen blinking occurs.

SUMMARY OF THE INVENTION

To solve the above-described problems, it is an object of the present invention to provide an apparatus and method for controlling a driving voltage for an image display device, in which, in order to prevent a driving voltage for the image display device and its peripheral circuits from deviating from an optimal value due to changes in temperature or component parts, an optical sensor is installed between the image display device and a screen or between the image display device and a projection lens, and the driving voltage for the image display device and its peripheral circuits is feedback controlled and optimized using the output signal of the optical sensor. Thus, the image display device provides an optimal contrast, and screen blinking is prevented.

In order to achieve the above object of the present invention, there is provided an apparatus for controlling a driving voltage for a digital liquid crystal display device having a polarization angle adjustor for adjusting the deflection angle of a digital liquid crystal display device. In the driving voltage controlling apparatus, an optical sensor senses light projected to a screen and converts the light into an electrical signal. A driving control circuit adds a first square wave driving signal with a predetermined frequency and amplitude to a second square wave driving signal with a higher frequency and lower amplitude than those of the first square wave driving signal, applies the resulting signal as the driving signal of the polarization angle adjustor, and controls the voltage of the first square wave driving signal so that the difference of a change in luminance is minimum, using the difference of the electrical signal of the optical sensor obtained due to a change in the level of the second square wave driving signal during one cycle.

To achieve the above object of the present invention, there is also provided an apparatus for controlling a driving voltage for an analog liquid crystal display device. In this apparatus, an optical sensor senses light projected to a screen and converts the light into an electrical signal. A driving control circuit adds a first square wave driving signal with a predetermined frequency and amplitude to a second square wave driving signal with a higher frequency and a lower amplitude than those of the first square wave driving signal, applies the resulting signal as the driving signal of the analog liquid crystal display device, and controls the voltage of the first square wave driving signal so that the difference of a change in luminance is minimum, using the difference of the electrical signal of the optical sensor obtained due to a change in the level of the second square wave driving signal during one cycle.

To achieve the above object of the present invention, there is also provided a method of controlling a driving voltage for a liquid crystal display device. In this method, a first square wave driving signal with a predetermined frequency and amplitude is added to a second square wave driving signal with a higher frequency and a lower amplitude than those of the first square wave driving signal. The result of the addition is output as the driving signal of the liquid crystal display device. Next, light is sensed from the edge area around the image display area of a screen and converted into an electrical signal. Thereafter, the voltage of the first square wave driving signal is controlled to minimize the difference of a change in luminance, using the difference of the electrical signal of the optical sensor obtained due to a change in the level of the second square wave driving signal during one cycle.

BRIEF DESCRIPTION OF THE DRAWINGS

The above objects and advantages of the present invention will become more apparent by describing in detail preferred embodiments thereof with reference to the attached drawings in which:

FIGS. 8(*a*)–8(*g*) show the waveforms of driving signals applied to FIG. 7;

FIG. 9 is a graph showing the relationship between the driving voltage and optical sensor output of a polarization angle adjustor in order to explain the present invention;

DETAILED DESCRIPTION OF THE INVENTION

Figure 1:
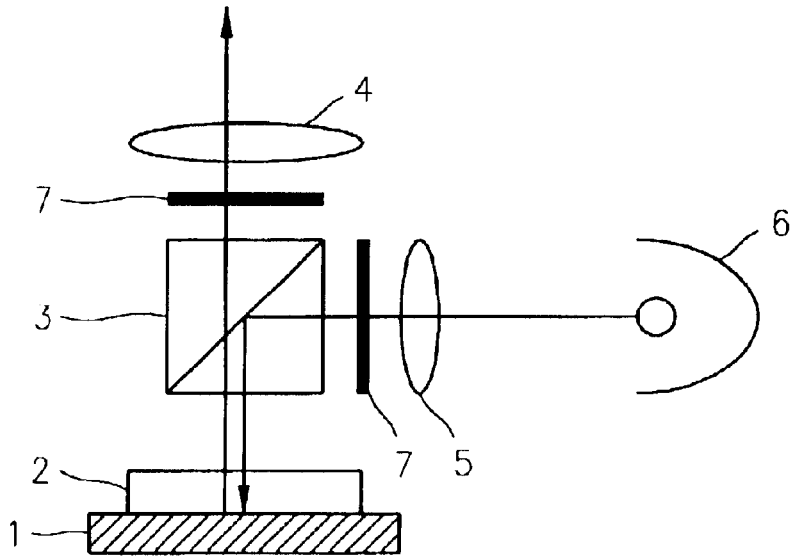
FIG. 1 (PRIOR ART)
FIG. 1 shows the structure of an image display apparatus using a conventional digital reflex image display device.
Figure 2A:
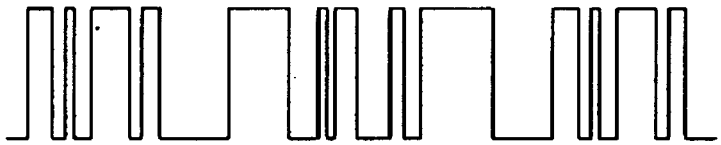
FIGS. 2(*a*)–2(*d*) show the waveforms of the driving voltage of a polarization angle adjustor in a digital reflex image display apparatus.
Figure 2B:
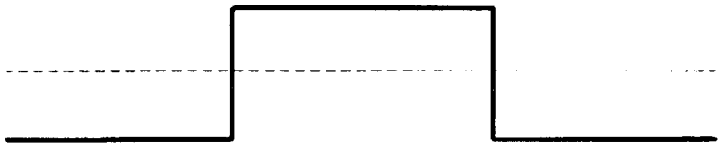
Figure 2C:
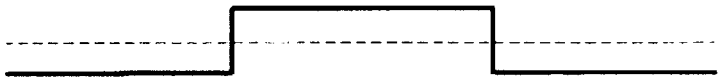
Figure 2D:
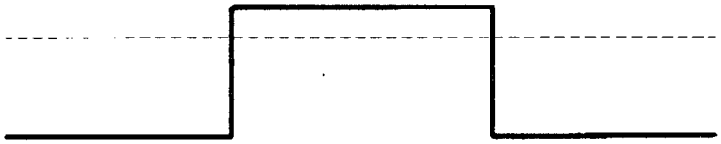
Figure 3A:
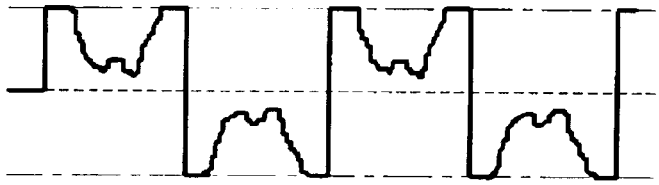
FIGS. 3(*a*)–3(*c*) show the waveforms of the driving voltage of an analog liquid crystal display device.
Figure 3B:
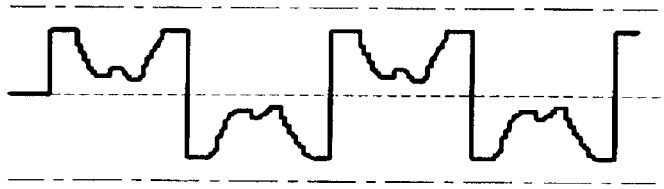
Figure 3C:
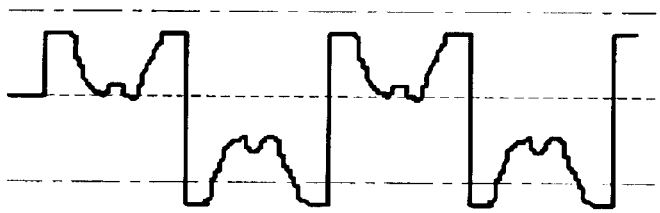
Figure 4:
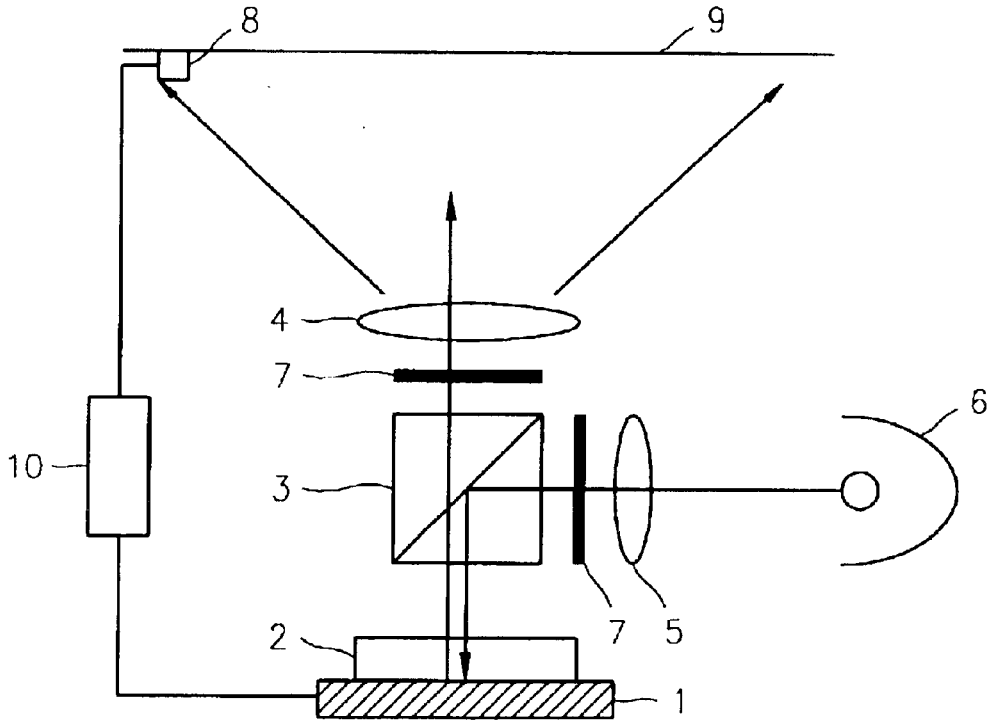
FIG. 4 shows the structure of a back projection-type image display apparatus according to the present invention.

As shown in FIG. 4, a back projection-type image display apparatus according to the present invention includes a reflex image display device 1, a polarization angle adjustor 2, a polarized beam splitter 3, a projection lens 4, a focusing lens 5, a light source lamp 6, polarization plates 7, an optical sensor 8, a projection screen 9 and a driving control circuit 10.

Figure 5:
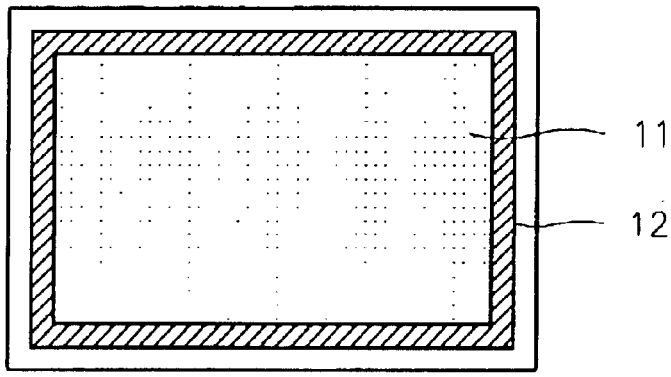
FIG. 5 shows the image display area and the edge area on the surface of an image display device.

The optical sensor 8 senses the light on the edge area of the image display device 1 projected from the projection lens 4, converts the light into an electrical signal and transmits the electrical signal to the driving control circuit 10, which controls the driving voltage of the polarization angle adjustor 2. In FIG. 5, the surface of the image display device 1 is composed of an image display area 11, and an edge area 12, which is subject to a voltage to be shown in black. The edge area 12 could be formed of pixels like the image display area, or a single electrode. The optical sensor 8 is installed such as to sense the light reflected by the edge area 12. The edge area 12 is blocked from light when an image is displayed on the image display area, so that the image does not reach the edge area 12. In FIG. 4, the optical sensor 8 is located within the projection screen 9. However, a front projection-type image display device can definitely adopt the present invention even if an optical sensor is located in front of a projection lens.

Figure 6:
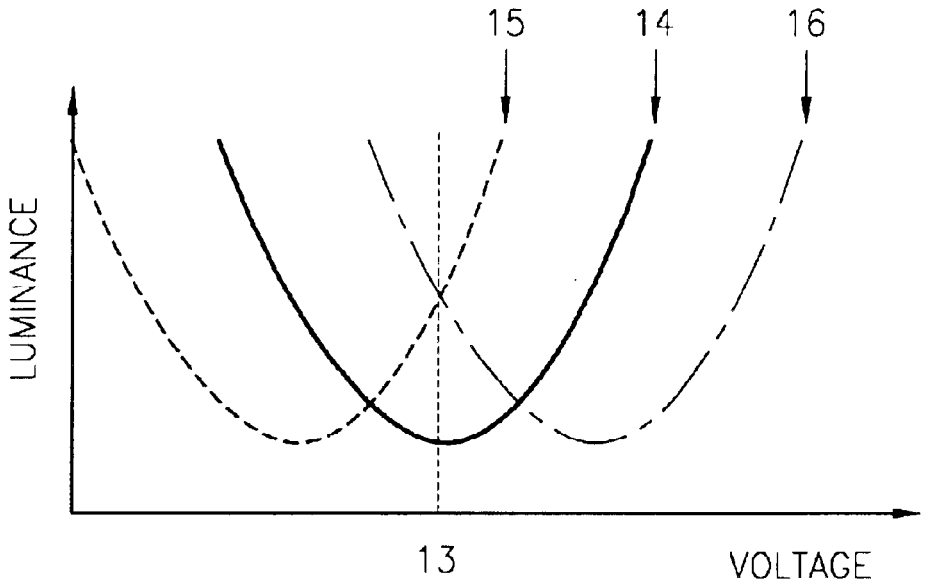
FIG. 6 is a graph showing the relationship between the driving voltage and luminance of a polarization angle adjustor.

FIG. 6 is a graph showing the relationship between the driving voltage and luminance of a polarization angle adjustor 2 when the edge area 12 of the image display device is blackened. When the voltage-luminance of the polarization angle adjustor 2 is shown in curve 14, the luminance is lowest at a driving voltage 13, which is an electric potential difference from the center voltage. That is, the contrast is high. Accordingly, the driving voltage of the polarization angle adjustor 2 can be adjusted to be the driving voltage 13. However, the curve 14 moves due to a change in the temperature of the polarization angle adjustor or a change in the polarization angle adjustor 2. If the polarization angle adjustor 2 is at a low temperature, the voltage-luminance of the polarization angle adjustor 2 is shown as in curve 15. If the polarization angle adjustor 2 is at a high temperature, the voltage-luminance of the polarization angle adjustor 2 is shown as in curve 16. Thus, the driving voltage of the polarization angle adjustor 2 is required to be controlled depending on a change in the surrounding temperature.

Figure 7:
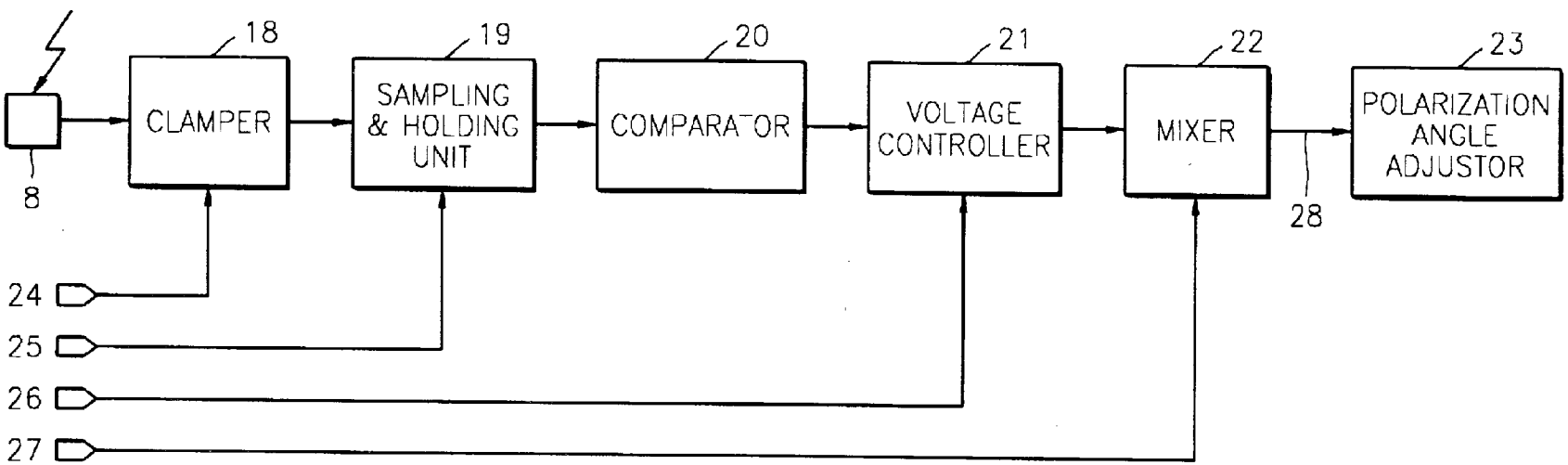
FIG. 7 is a detailed block diagram showing the structure of the driving control circuit of FIG. 4.

A method of controlling the driving voltage of a polarization angle adjustor 2 will now be described referring to FIGS. 7 and 8. As shown in FIG. 7, the driving control circuit 10 of FIG. 4 includes a clamper 18, a sampling & holding unit 19, a comparator 20, a voltage controller 21 and a mixer 22.

In FIGS. 7 and 8, reference numeral 24 denotes a clamp signal (hereinafter, referred to as a Cp signal), reference numeral 25 denotes a sample hold signal (hereinafter, referred to as an Sp signal), reference numeral 26 denotes a conventional inversion driving signal (which is also referred to as a first square wave driving signal), and reference numeral 27 denotes a fine-amplitude square wave signal (which is also referred to as a second square wave driving signal). Reference numeral 28 denotes the driving signal of a polarization angle adjustor 23, which is obtained by overlapping and summing the fine-amplitude square wave signals 27 with a frequency 10–40 times higher than the conventional inversion driving signal 26. The amplitude of the fine-amplitude square wave signal can be just about 1/10 to 1/20 of the amplitude of the inversion driving signal.

With the Cp signal 24 high when the fine-amplitude square wave signal 27 is negative, the clamper 18 clamps the output signal of the optical sensor 8 to zero volts. Next, with the Sp signal 25 high when the fine-amplitude square wave signal 27 is positive, the sampling & holding unit 19 memorizes the potentials of the output signal of the optical sensor 8 in the periods when the Sp signal 25 is high, by charging them in a device, such as a capacitor.

When the optical sensor 8 outputs a signal 29 of FIG. 8(*f*), voltage charged according to the Sp signal is negative, and the luminance sensed by the optical sensor 8 decreases as the driving voltage of the polarization angle adjustor 23 increases. Accordingly, this case corresponds to a state 31 in FIG. 9 showing the relationship between the driving voltage of a polarization angle adjustor and the luminance sensed by an optical sensor. Thus, an optimal contrast can be obtained by increasing the driving voltage of a polarization angle adjustor. On the other hand, when the optical sensor 8 outputs a signal 30 of FIG. 8(*g*), voltage charged according to the Sp signal is positive, and the luminance sensed by the optical sensor 8 increases as the driving voltage of the polarization angle adjustor 23 increases. Accordingly, this case corresponds to a state 32 in FIG. 9. Thus, an optimal contrast can be obtained by decreasing the driving voltage of a polarization angle adjustor.

The comparator 20 sends a command to increase or decrease the driving voltage of the polarization angle adjustor 23 to the voltage controller 21, depending on the positive/negative value of potential charged by the sampling & holding unit 19. The voltage controller 21 controls the driving voltage of the polarization angle adjustor 23 in accordance with a command received from the comparator 20, in synchronization with the conventional inversion driving signal 26. The mixer 22 applies the driving signal 28 to which the fine-amplitude square wave signal 27 has been added, to the polarization angle adjustor 23. When the driving control circuit 10 receives another signal from the optical sensor 8, such operations described above repeat.

Through several adjustments of the driving voltage of the polarization angle adjustor 23, the output of the sampling & holding unit 19 is finally close to 0V, and equilibrium is established at a state 33 of FIG. 9. Thus, a driving voltage for generating an optimal contrast can be obtained.

In the above-described embodiment, when the fine-amplitude square wave signal is negative, the Cp signal 24 is high, and accordingly the output signal of the optical sensor 8 is clamped to 0V. When the fine-amplitude square wave signal is positive, sampling and holding are performed. However, in another embodiment of the present invention, when the fine-amplitude square wave signal is positive, clamping to 0V is performed. When the fine-amplitude square wave signal is negative, the potentials of the output signal of the optical sensor 8 are sampled and held. Accordingly, the driving voltage of the polarization angle adjustor 23 can be obtained by interpreting the graph of FIG. 9 in the aforementioned method.

Figure 10:
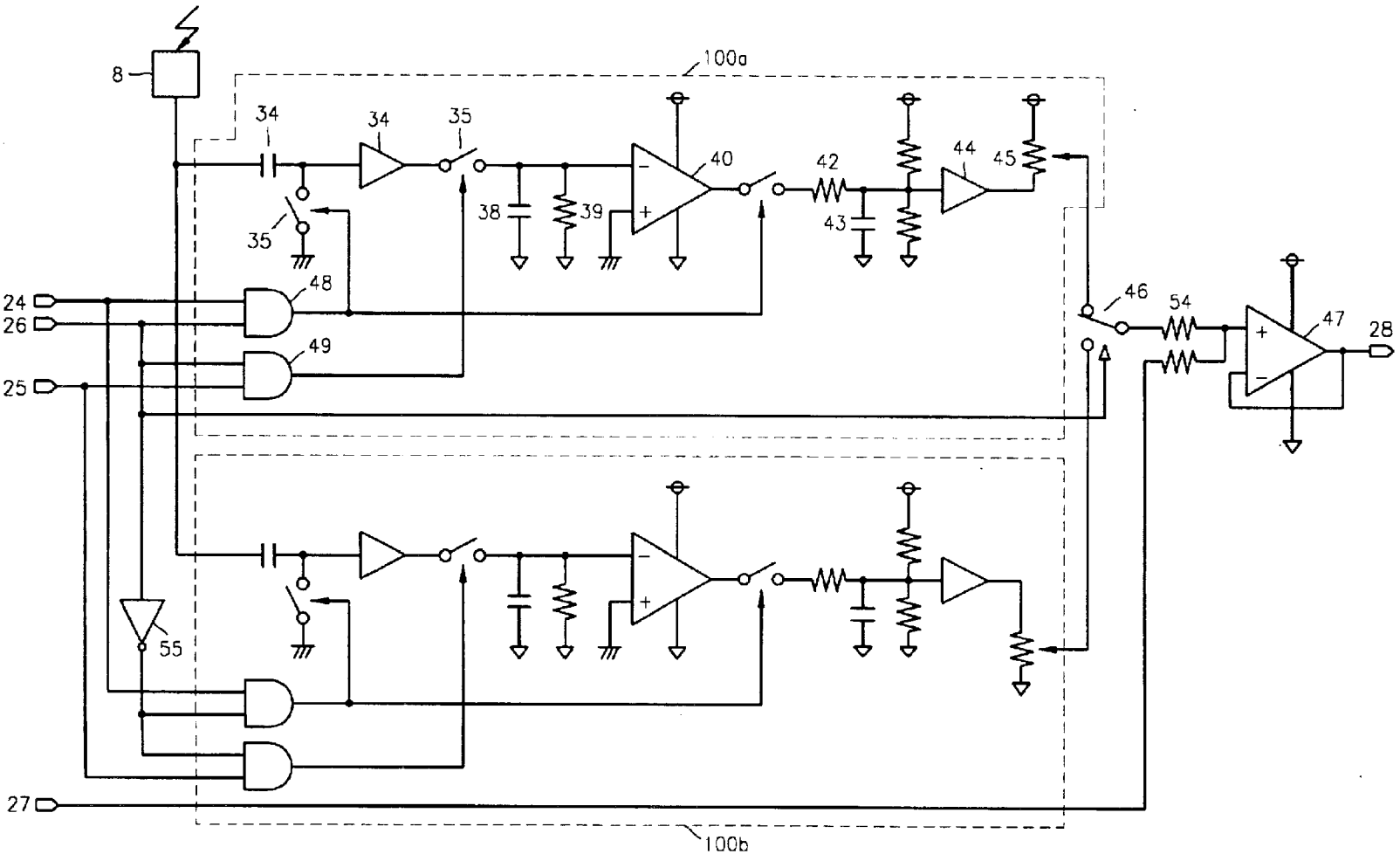
FIG. 10 is a circuit diagram of an embodiment of the driving control circuit of FIG. 7.

FIG. 10 is a detailed circuit diagram of the driving control circuit of FIG. 7. In the driving control circuit, upper and lower circuits 100*a* and 100*b* have almost the same structure. The upper circuit 100*a* performs the voltage control operation for the case that the inversion driving signal 26 is positive, while the lower circuit 100*b* performs the voltage control operation for the case that the inversion driving signal 26 is negative. Accordingly, by the help of a Cp signal, an Sp signal, AND circuits 48 and 49 and an inverter 55, the upper circuit 100*a* generates a pulse only when the inversion driving signal 26 is positive, and the lower circuit 100*b* generates a pulse only when the inversion driving signal 26 is negative.

In the driving control circuit, the clamp circuit is composed of a capacitor 34 and a switch 35, and the sampling & holding circuit is composed of a switch 37 and a capacitor 38. The comparator is an operational amplifier 40 whose positive input port is grounded. The voltage controller includes a switch 41, a resistor 42, a capacitor 43, a buffer 44, a variable resistor 45, and a switch 46. The mixer, which is a fine-amplitude signal adder, is composed of an operational amplifier 47 and an input port resistor 54.

A direct current (DC) component is removed from the output signal of the optical sensor 8 by the capacitor 34, and the resulting output signal is clamped to 0V when the Cp signal is high. Then, when the Sp signal is high, the switch 37 is turned on, and the potentials of the output signal of the optical sensor 8 are charged in the capacitor 38. The operational amplifier 40 reverses the phase of the potential of the capacitor 38, outputs the resulting potential, and controls the potential of the capacitor 43 using a time constant set by the resistor 42 and the capacitor 43 during the time when the switch 41 is in an on state, that is, while the Cp signal is high. Thereafter, the phase-reversed potential is applied to the switch 46 via the buffer 44 and the variable resistor 45. The switch 46 selects the driving voltage of the upper circuit 100*a* when the inversion driving signal 26 is positive, or selects the driving voltage of the lower circuit 100*b* when the inversion driving signal 26 is negative. The fine-amplitude signal adder, which is composed of the operational amplifier 47 and the input port resistor 54, adds the fine amplitude square wave signal 27 to the selected driving voltage to obtain the driving signal 28 of a polarization angle adjustor.

The driving control circuit of FIG. 10 is composed of two independent circuits respectively for the case that an inversion driving signal is positive and that it is negative, so that it can obtain an optimal contrast by overcoming all changes such as the extension or compression of the optimal driving voltage of a polarization extensive device as well as the parallel movement thereof.

Figure 11:
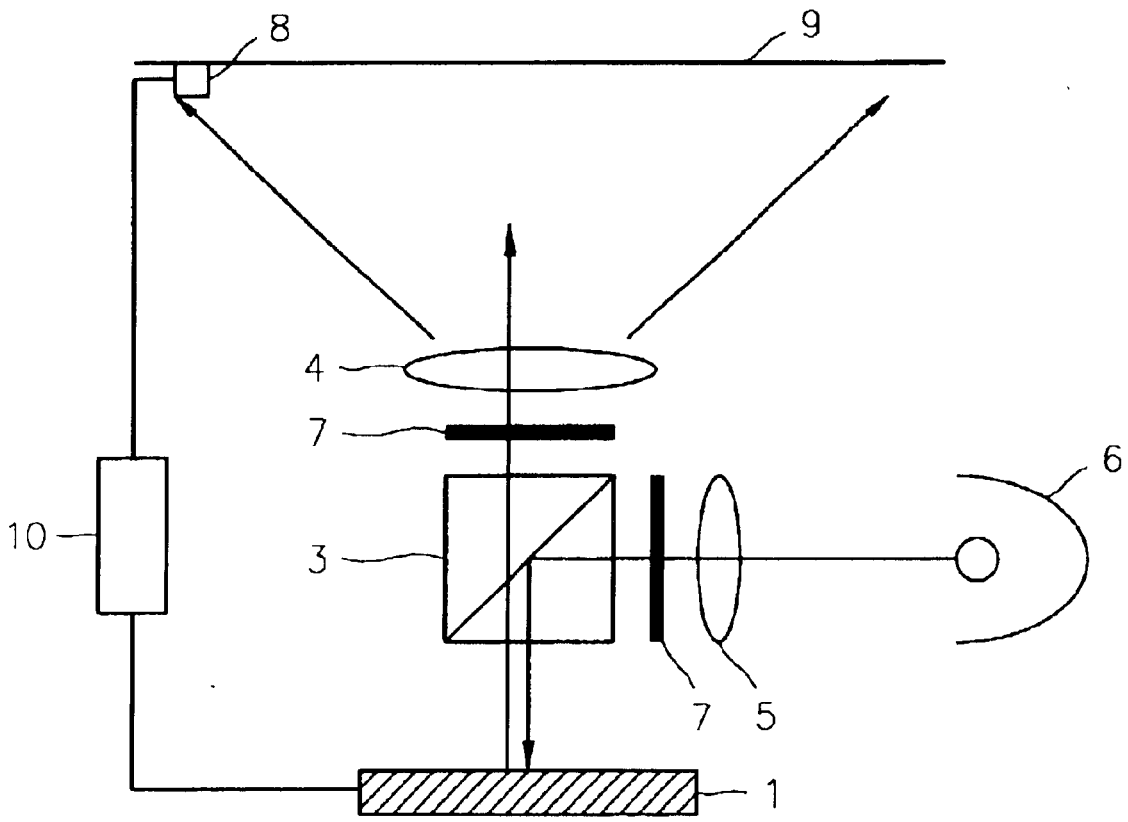
FIG. 11 shows the structure of an image display apparatus using an analog image display device according to the present invention.

An image display apparatus adopting an analog image display device according to the present invention is shown in FIG. 11. The image display apparatus adopting an analog image display device does not require a polarization angle adjustor in contrast with an image display apparatus adopting a digital image display device. Accordingly, the driving signal 28 of FIG. 8(*c*) is applied to the edge area 12 of FIG. 5, and light reflected by the edge area 12 is sensed by the optical sensor 8. The analog image display apparatus controls the driving voltage of a video signal using the sensed light in the same method as described above for a digital image display apparatus. A detailed block diagram of the driving control circuit of the analog image display apparatus of FIG. 11 is shown in FIG. 12.

Figure 12:
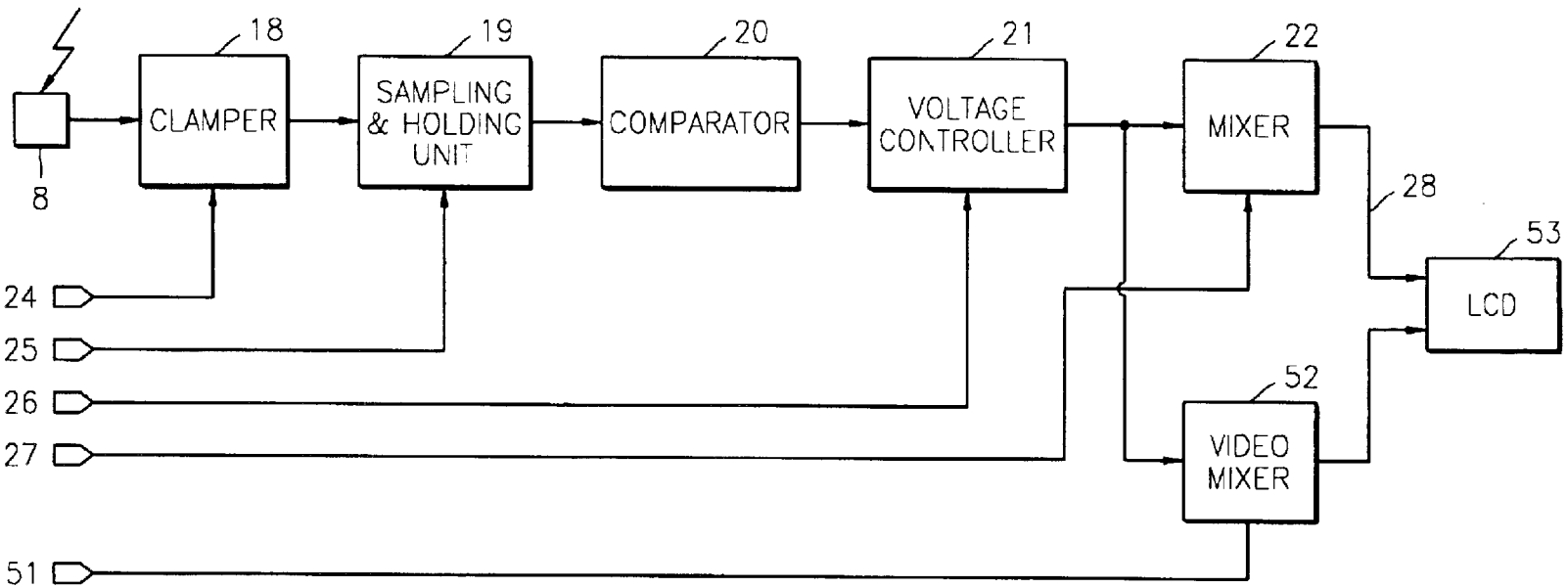
FIG. 12 is a detailed block diagram of the driving control circuit of FIG. 11.

In FIG. 12, reference numeral 51 denotes a video signal, and reference numeral 52 denotes a video driving circuit for AC driving a video signal, that is, a video mixer. The edge area of a liquid crystal display (LCD) 53 is subject to the output signal of a fine-amplitude signal adder, which is the mixer 22, and the image display area is subject to the output signal of the video driving circuit, which is the video mixer 52. Accordingly, the analog image display apparatus can perform control capable of obtaining an optimal contrast and preventing blinking, in the same method as that used by a digital image display apparatus.

As described above, according to the present invention, the edge area of an image display device is subject to a minute change in the amplitude of a driving voltage, and the optical change is sensed and used to control the driving voltage of the image display device. Thus, regardless of property changes due to the temperature of an image display device and its peripheral devices, an image display apparatus according to the present invention can display a picture with an optimal contrast. Also, blinking due to flickering can be reduced to the minimum.

The present invention can be implemented as a method, an apparatus, and a system. When the present invention is executed in software programs, the component units of the present invention are code segments for executing essential operations. The programs or code segments can be stored in a processor readable medium, or transferred by a transfer medium or a communication network through a computer data signal combined with a carrier. The processor readable medium includes any of the media capable of storing or transferring information, for example, electronic circuits, semiconductor memory devices, ROMs, flash memory, erasable ROMs (EROM), floppy discs, optical discs, hard discs, optical fibres, air, electric fields, and radio frequency (RF) networks. The computer data signal can be any of signals capable of being transferred over a transmission medium such as electronic network channels, optical fibres, air, electric fields, and RF networks.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An apparatus for controlling a driving voltage for an image display device having a polarization angle adjustor for adjusting the deflection angle of a digital liquid crystal display device, the controlling apparatus comprising:

an optical sensor for sensing light projected to a screen and converting the light into an electrical signal;

a driving control circuit for adding a first square wave driving signal with a predetermined frequency and amplitude to a second square wave driving signal with a higher frequency and lower amplitude than those of the first square wave driving signal, thereby to generate an added signal, applying the added signal as a driving signal of the polarization angle adjustor, and controlling the voltage of the first square wave driving signal so that the difference of a change in luminance is minimum, using the difference of the electrical signal of the optical sensor obtained due to a change in the level of the second square wave driving signal during one cycle.

2. The apparatus of claim 1, wherein the optical sensor is installed on an edge area around an image display area of the screen.

3. The apparatus of claim 2, wherein the edge area is a black area.

4. The apparatus of claim 1, wherein the driving control circuit controls the voltage of the first square wave driving signal so that a relationship between the driving voltage and optical property of the polarization angle adjustor is shown by an inverse parabolic graph and the optimal value of the optical property sensed by the optical sensor installed on the edge area of the screen reaches the lowest value in the inverse parabolic graph.

5. The apparatus of claim 1, wherein the first square wave driving signal is formed by inverting from a positive value to a negative value or from a negative value to a positive value on a frame-by-frame basis.

6. The apparatus of claim 1, wherein the frequency of the second square wave driving signal is at least 10 times higher than that of the first square wave driving signal and its amplitude is 1/10 to 1/20 of the amplitude of the first square wave driving signal.

7. The apparatus of claim 1, wherein the driving control circuit comprises:

a clamper for receiving the electrical signal from the optical sensor and clamping the voltage of the received electrical signal to a predetermined voltage in regions where the second square wave driving signal is negative;

a sampling & holding unit for receiving the clamped signal from the clamper and sampling and holding the voltage of the received signal in regions where the second square wave driving signal is positive;

a comparator for comparing the voltage held by the sampling & holding unit with the predetermined voltage of the clamper, generating a first control signal when the held voltage is lower than the predetermined voltage, and generating a second control signal when the held voltage is higher than the predetermined voltage;

a voltage controller for receiving the first square wave driving signal, increasing the voltage of the first square wave driving signal when the comparator generates the first control signal, and decreasing the voltage of the first square wave driving signal when the comparator generates the second control signal; and a mixer for adding the second square wave driving signal to the output signal of the voltage controller.

8. The apparatus of claim 7, wherein the predetermined voltage is 0V.

9. The apparatus of claim 1, wherein the driving control circuit comprises:

a clamper for receiving the electrical signal from the optical sensor and clamping the voltage of the received electrical signal to a predetermined voltage in the regions where the second square wave driving signal is positive;

a sampling & holding unit for receiving the clamped signal from the clamper and sampling and holding the voltage of the received signal in the regions where the second square wave driving signal is negative;

a comparator for comparing the voltage held by the sampling & holding unit with the predetermined voltage of the clamper, generating a second control signal when the held voltage is lower than the predetermined voltage, and generating a first control signal when the held voltage is higher than the predetermined voltage;

a voltage controller for receiving the first square wave driving signal, increasing the voltage of the first square wave driving signal when the comparator generates the first control signal, and decreasing the voltage of the first square wave driving signal when the comparator generates the second control signal; and a mixer for adding the second square wave driving signal to the output signal of the voltage controller.

10. The apparatus of claim 9, wherein the predetermined voltage is 0V.

11. An apparatus for controlling a driving voltage for an analog liquid crystal display device, the apparatus comprising:

an optical sensor for sensing light projected to a screen and converting the light into an electrical signal; and a driving control circuit for adding a first square wave driving signal with a predetermined frequency and amplitude to a second square wave driving signal with a higher frequency and a lower amplitude than those of the first square wave driving signal thereby to generate an added signal, applying the added signal as the driving signal of the analog liquid crystal display device, and controlling the voltage of the first square wave driving signal so that the difference of a change in luminance is minimum, using the difference of the electrical signal of the optical sensor obtained due to a change in the level of the second square wave driving signal during one cycle.

12. The apparatus of claim 11, wherein the optical sensor is installed on an edge area around an image display area of the screen.

13. The apparatus of claim 12, wherein the edge area is a black area.

14. The apparatus of claim 11, wherein the driving control circuit controls the voltage of the first square wave driving signal so that the relationship between the driving voltage and optical property of the analog liquid crystal display device is shown by an inverse parabolic graph and the optimal value of the optical property sensed by the optical sensor installed on the edge area of the screen reaches the lowest value in the inverse parabolic graph.

15. The apparatus of claim 11, wherein the first square wave driving signal is formed by inverting from a positive value to a negative value or from a negative value to a positive value on a frame-by-frame basis.

16. The apparatus of claim 11, wherein the frequency of the second square wave driving signal is at least 10 times higher than that of the first square wave driving signal and its amplitude is 1/10 to 1/20 of the amplitude of the first square wave driving signal.

17. The apparatus of claim 16, wherein the predetermined voltage is 0V.

18. The apparatus of claim 11, wherein the driving control circuit comprises:

a clamper for receiving the electrical signal from the optical sensor and clamping the voltage of the received electrical signal to a predetermined voltage in regions where the second square wave driving signal is negative;

a sampling & holding unit for receiving the clamped signal from the clamper and sampling and holding the voltage of the received signal in regions where the second square wave driving signal is positive;

a comparator for comparing the voltage held by the sampling & holding unit with the predetermined voltage of the clamper, generating a first control signal when the held voltage is lower than the predetermined voltage, and generating a second control signal when the held voltage is higher than the predetermined voltage;

a voltage controller for receiving the first square wave driving signal, increasing the voltage of the first square wave driving signal when the comparator generates the first control signal, and decreasing the voltage of the first square wave driving signal when the comparator generates the second control signal; and a mixer for adding the second square wave driving signal to the output signal of the voltage controller.

19. The apparatus of claim 18 wherein the predetermined voltage is 0V.

20. The apparatus of claim 11, wherein the driving control circuit comprises:

a clamper for receiving the electrical signal from the optical sensor and clamping the voltage of the received electrical signal to a predetermined voltage in regions where the second square wave driving signal is positive;

a sampling & holding unit for receiving the clamped signal from the clamper and sampling and holding the voltage of the received signal in regions where the second square wave driving signal is negative;

a comparator for comparing the voltage held by the sampling & holding unit with the predetermined voltage of the clamper, generating a second control signal when the held voltage is lower than the predetermined voltage, and generating a first control signal when the held voltage is higher than the predetermined voltage;

a voltage controller for receiving the first square wave driving signal, increasing the voltage of the first square wave driving signal when the comparator generates the first control signal, and decreasing the voltage of the first square wave driving signal when the comparator generates the second control signal; and a mixer for adding the second square wave driving signal to the output signal of the voltage controller.

21. A method of controlling a driving voltage for a liquid crystal display device, the method comprising:

(a) adding a first square wave driving signal with a predetermined frequency and amplitude to a second square wave driving signal with a higher frequency and a lower amplitude than those of the first square wave driving signal, thereby to generate an added signal, and applying the added signal as the driving signal of the liquid crystal display device;

(b) sensing light from an edge area around an image display area of a screen and converting the light into an electrical signal; and (c) controlling the voltage of the first square wave driving signal so that the difference of a change in luminance is minimum, using the difference of the electrical signal of the optical sensor obtained due to a change in the level of the second square wave driving signal during one cycle.

22. The method of claim 21, wherein the edge area is a black area.

23. The method of claim 21, wherein, in step (c), the voltage of the first square wave driving signal is controlled so that the optimal value of the optical property sensed by the edge area of the screen reaches the lowest value on an inverse parabolic graph showing the relationship between the driving voltage and optical property of the liquid crystal display device.

24. The method of claim 21, wherein the first square wave driving signal is formed by inverting from a positive value to a negative value or from a negative value to a positive value on a frame-by-frame basis.

25. The method of claim 21, wherein the frequency of the second square wave driving signal is at least 10 times higher than that of the first square wave driving signal and its amplitude is 1/10 to 1/20 of the amplitude of the first square wave driving signal.

26. The method of claim 21, wherein the step (c) comprises:

(c1) receiving the electrical signal obtained in step (b) and clamping the voltage of the received electrical signal to a predetermined voltage in regions where the second square wave driving signal is negative;

(c2) receiving the electrical signal clamped in step (c1) and sampling and holding the voltage of the received signal in regions where the second square wave driving signal is positive;

(c3) comparing the voltage held in step (c2) with the predetermined voltage, increasing the voltage of the first square wave driving signal when the held voltage is lower than the predetermined voltage, and decreasing the voltage of the first square wave driving signal when the held voltage is higher than the predetermined voltage.

27. The method of claim 26, wherein the predetermined voltage is 0V.

28. The method of claim 21, wherein the step (c) comprises:

(c1) receiving the electrical signal obtained in step (b) and clamping the voltage of the received electrical signal to a predetermined voltage in regions where the second square wave driving signal is positive;

(c2) receiving the electrical signal clamped in step (c1) and sampling and holding the voltage of the received signal in regions where the second square wave driving signal is negative;

(c3) comparing the voltage held in step (c2) with the predetermined voltage, decreasing the voltage of the first square wave driving signal when the held voltage is lower than the predetermined voltage, and increasing the voltage of the first square wave driving signal when the held voltage is higher than the predetermined voltage.

29. The method of claim 27, wherein the predetermined voltage is 0V.

* * * * *